United States Patent [19]

Ingram

[11] 4,370,819

[45] Feb. 1, 1983

[54] APPARATUS FOR DEPOSITING AND SPREADING BALLAST

[76] Inventor: Robert E. Ingram, 726 Okuma Dr., Chester, Va. 23831

[21] Appl. No.: 247,213

[22] Filed: Mar. 24, 1981

[51] Int. Cl.[3] ..... E02F 5/22

[52] U.S. Cl. ..... 37/104; 105/239

[58] Field of Search ..... 37/104, 105; 105/239, 105/248

[56] References Cited

U.S. PATENT DOCUMENTS

| | | | |
|---|---|---|---|
| 1,743,579 | 1/1930 | Straw | 105/239 |
| 1,834,670 | 12/1931 | Yett | 105/248 X |
| 1,977,308 | 10/1934 | Hindahl | 105/239 |
| 2,132,176 | 10/1938 | McWilliams | 37/104 |
| 2,266,633 | 12/1941 | Gill | 37/105 |
| 2,555,173 | 5/1951 | White | 105/239 |
| 2,989,930 | 6/1961 | Flowers | 105/248 |
| 3,019,536 | 2/1962 | Kershaw | 105/239 X |
| 3,250,027 | 5/1966 | Stein | 37/105 |
| 3,257,744 | 6/1966 | Buhler | 37/105 |
| 3,587,475 | 6/1971 | Damy | 105/287 |
| 3,614,932 | 10/1971 | Damy | 105/239 |
| 3,651,587 | 3/1972 | Plasser et al. | 37/105 |
| 3,654,872 | 4/1972 | Fearon | 105/239 |
| 3,667,400 | 6/1972 | Damy | 105/239 |
| 3,822,650 | 7/1974 | Fearon | 105/239 |
| 4,043,398 | 8/1977 | Folser et al. | 37/104 |
| 4,196,532 | 4/1980 | Muller | 37/105 |
| 4,263,851 | 4/1981 | Theurer et al. | 37/104 |
| 4,266,352 | 5/1981 | Newman | 37/105 |

FOREIGN PATENT DOCUMENTS

| | | | |
|---|---|---|---|
| 204587 | 7/1959 | Austria | 37/104 |
| 907911 | 3/1946 | France | 105/239 |
| 1169721 | 11/1969 | United Kingdom | 37/104 |

*Primary Examiner*—E. H. Eickholt

*Attorney, Agent, or Firm*—Richard P. Matthews

[57] ABSTRACT

An apparatus for depositing and spreading ballast between and exteriorly of railroad rails and cross ties. A hand pushed or motor driven ballast spreader has a ballast hopper supported by a frame mounted on wheels engageable with the railroad rails. The hopper has an open top and an open bottom with converging lower walls. Ballast may be deposited between the rails through a door mounted horizontally beneath the frame and through a slot in a fixed chute. Ballast may also be deposited exteriorly of the heads of the cross ties by passing through the fixed chute and through a pivotally movable chute which is pivotally mounted near each lateral end of the fixed chute. Resiliently mounted blades clear excess ballast from the ties between the rails and from the heads of the ties exteriorly of the rails.

4 Claims, 7 Drawing Figures

APPARATUS FOR DEPOSITING AND SPREADING BALLAST

This invention relates to a ballast depositing and spreading apparatus, and more particularly, to such an apparatus that can be driven directly on the rail and driven between two opposed railroad jacks in a raised and upright position while depositing railroad ballast.

BACKGROUND OF THE INVENTION

Generally, in the construction of new siding, stone ballast must be applied with large hopper cars pulled or pushed by a locomotive and crew. If not possible to get a ballast train, which is expensive, a loader of some type must be used to fill up track with stone which is very time consuming. With a train or loaders, the stone covers the cross ties up to the top of the rails. To surface or raise this track by lowering the elevation of the ballast one can either use expensive tamping machines, or a ballast regulator which shape and move ballast. Most often if one has to raise the track six inches or more the filling up of track must be repeated a second time.

If tamping is done by hand, as opposed to machine, then a lot of shoveling is required which makes it more expensive and time consiming. In using the apparatus of the present invention as opposed to tampers, ballast regulators, work trains, or the like, one can in the course of building the track, jack up the track to the desired elevation. This allows one to drive between the jacks while depositing stone to just the desired amount for easy tamping. No shoveling is required, and no jack holes need to be dug to raise the track. Ties do not have to be uncovered by hand in order to tamp them. Upon tamping the track it is then aligned with no large amount of stone, yet on the outside heads of ties, the track can be easily placed on the final line without machines.

When lining is complete, the apparatus of this invention then adds final stone to centers and heads, after which it puts in the outside ballast line. All of this is accomplished with a minimum of labor. This saves considerable amount of stone that is not wasted by putting in too much.

This machine has a good potential for use in yards, or for filling in rock at washouts. With just a minimum amount of track support this machine can replace rock as it proceeds along washout area. This would eliminate special high rail dump truck loaders or the like. At the washout area and in many cases the area is very inaccessible and has room for only one machine which most often cannot get off the tracks.

This machine cuts the labor cost involved in distributing rock, surfacing and lining nearly 75 percent, not to mention the amount saved in stone material. Primarily this machine is for use by small railroad lines and contractors who cannot afford large, and expensive machines that serve only one of several basic functions required to complete the work.

The apparatus itself includes a frame mounted on wheels with the wheels engageable with the railroad tracks. Hopper means having an open top and an open bottom is supported by the frame and acts as a flow through conduit for the ballast which takes the form of small stones or gravel. A horizontally disposed door supported by a fixed chute means beneath the frame controls the distribution of ballast between the railroad tracks. Vertically disposed doors mounted in pivotally movable chute means on opposite sides of the fixed chute means controls the distribution of ballast laterally just beyond the heads of the cross ties. Finally, a first resiliently mounted blade means is engageable with any excess ballast deposited between the railroad tracks and a pair of resiliently mounted blade means on opposite sides of the frame clear any excess ballast from the heads of the cross ties.

Specially positioned baffle means cooperate with the location of the horizontally mounted door to insure that ballast is delivered from the hopper efficiently and assists in avoiding clogging of the ballast within the hopper and chute means. The latter converge to a smaller cross sectional area as they extend laterally outwardly from the exit of the hopper and effectively throttle the delivery of the ballast at the heads of the cross ties thereby assisting in delivering too much ballast in any given location. The system also eliminates so much of the shoveling heretofore required that substantially more track can be graded per unit time than was heretofore possible.

The inherent advantages and improvements of the present invention will become more readily apparent by consideration of the following detailed description of the invention and by reference to the drawings wherein.

DETAILED DESCRIPTION OF THE INVENTION

Figure 1:
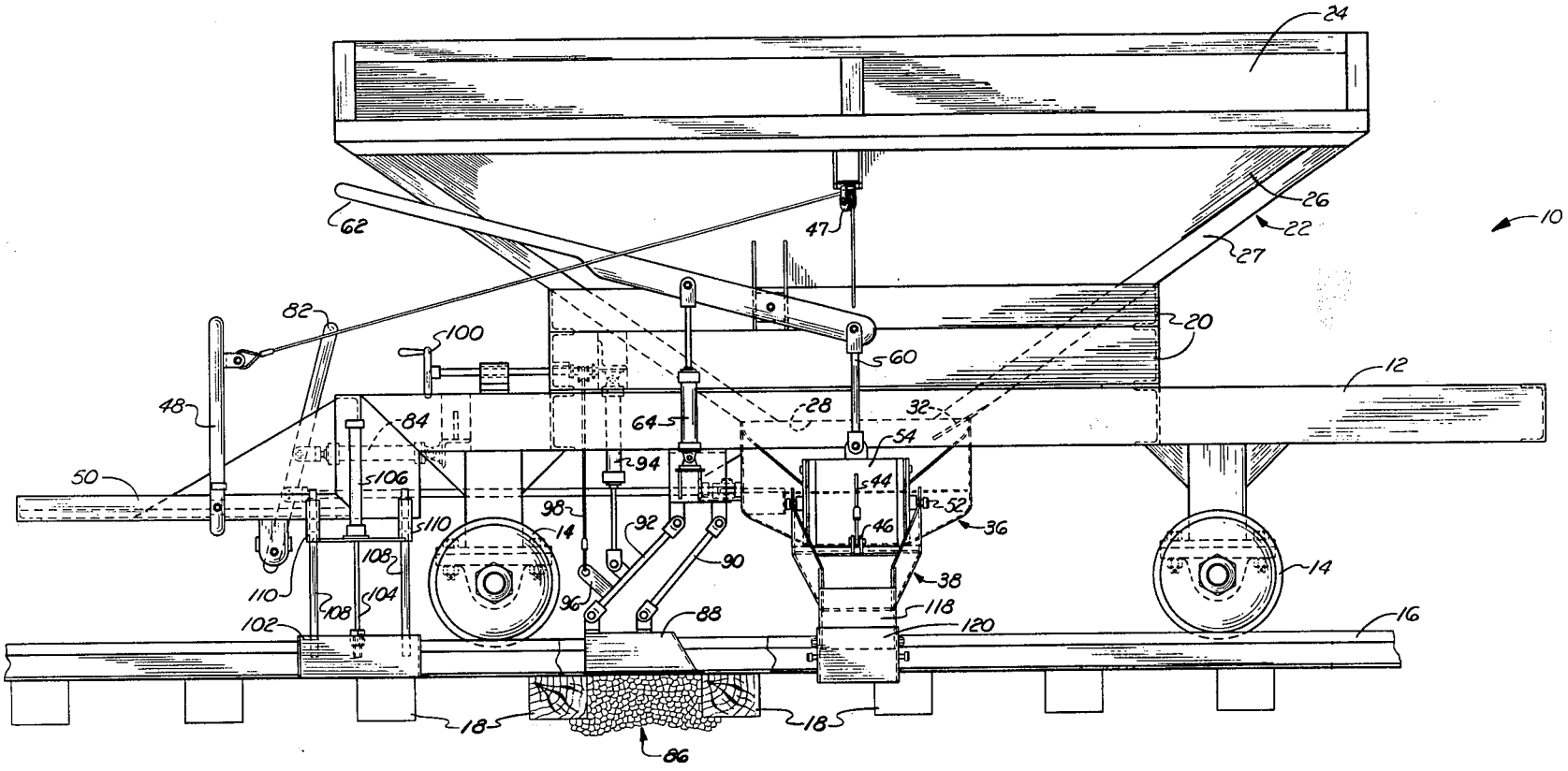
FIG. 1 is a side elevational view, with portions broken away and partially in vertical cross section, showing the ballast depositing and spreading apparatus of the present invention.

Referring now to FIG. 1 of the drawings, there is illustrated a ballast spreading apparatus, indicated generally at 10. The ballast spreading apparatus has a main frame 12 suitably supported by wheels 14 engageable with rails 16 of a railroad track laid on cross ties 18. The main frame 12 supports a built up sub-frame provided by channel sections 22 in order to support a ballast-containing hopper, indicated generally at 22. Hopper 22 has a generally rectangular open-topped portion 24 and opposed pairs of inwardly converging bottom walls 26 which have reinforcing plates 27 at the wall junctures. The hopper 22 has an open bottom 28 and a pair of inwardly and downwardly sloping baffle plates 30 (FIG. 2) which extend from the longitudinally extending side walls 26. The laterally extending bottom side walls of the hopper 22 have a single inwardly and downwardly sloping baffle plate 32 shown in FIG. 1. No baffle plate is provided on the opposite side wall so as not to interfere with gravity fall of ballast as it is being deposited and as will be evident hereinafter.

Figure 6:
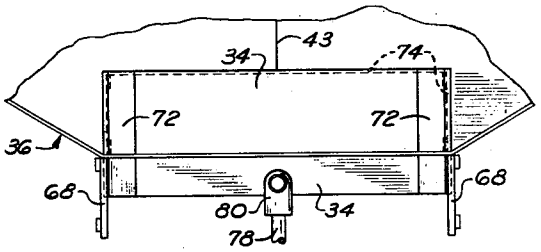
FIG. 6 is a fragmentary top plan view similar to FIG. 3 but showing the door closed.

The hopper 22, open at top and bottom, is intended to provide a reservoir of ballast for deposition between and exteriorly of the rails 16 and cross ties 18. That side of the hopper 22 which does not have a baffle plate at the bottom is positioned over a centrally disposed door 34, shown in FIG. 1, and even more clearly in FIGS. 3–8. Door 34 is shown in open position in FIG. 3 and in closed position in FIG. 6. When centrally located door 34 is open, ballast is free to fall by gravity between rails 16. Door 34 is mounted for movement in a horizontal plane and extends through one side of a fixed chute means 36 as is indicated generally in FIGS. 3–8.

Movable chute means are also illustrated in these figures and is indicated generally therein at 38. Fixed chute means 36 has an open upper inlet portion at 40 which abuts and generally conforms to the bottom opening 28 of hopper 22. The fixed chute means 36 also has downwardly and outwardly extending legs 42 which converge in cross sectional area as they extend outwardy from the inlet to the chute means 36. These legs 42 have walls which enclose the chute on four sides, the bottom walls of which come to a peak at 43 as shown in FIGS. 3 and 7.

Figure 2:
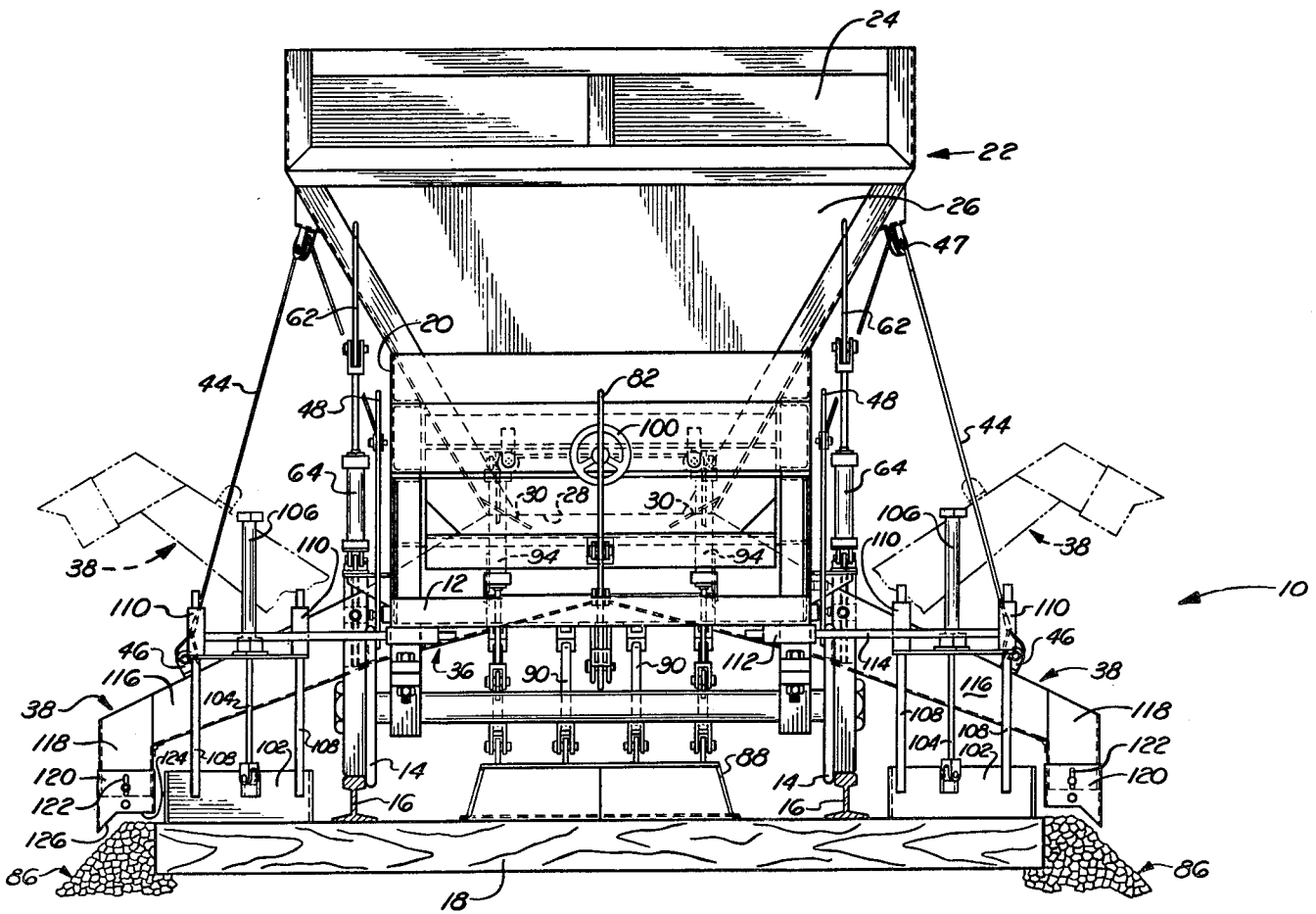
FIG. 2 is an end elevational view of FIG. 1.

Referring now to FIG. 2, there is illustrated cable means 44 secured to a lifting bracket 46 on movable chute means 38 in order to lift the movable chute 38 to the phantom position illustrated in FIG. 2. The cable means 44 extend over pulleys 47 mounted on opposite sides of hopper 22 and are controlled by manual movement of a lever 48 in order to raise or lower the movable chute means 38. From FIG. 1, it is evident that lever 48 is attached to a rear platform 50 from which all levers or actuating controls may be operated. In addition, if it is desired to have propulsion means for the ballast spreading apparatus, a motor means may conveniently be mounted on rear platform 50.

Figure 5:
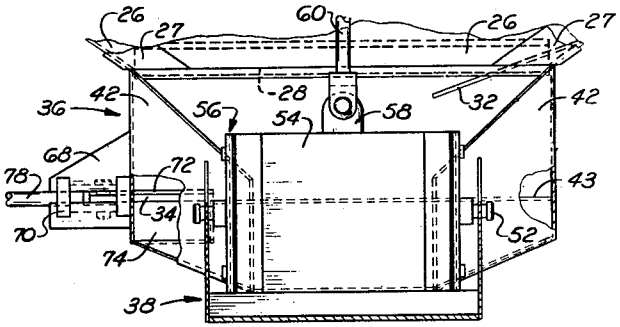
FIG. 5 is an end elevational view of the chutes of FIG. 3, taken partially in vertical cross section and with portions broken away.
Figure 3:
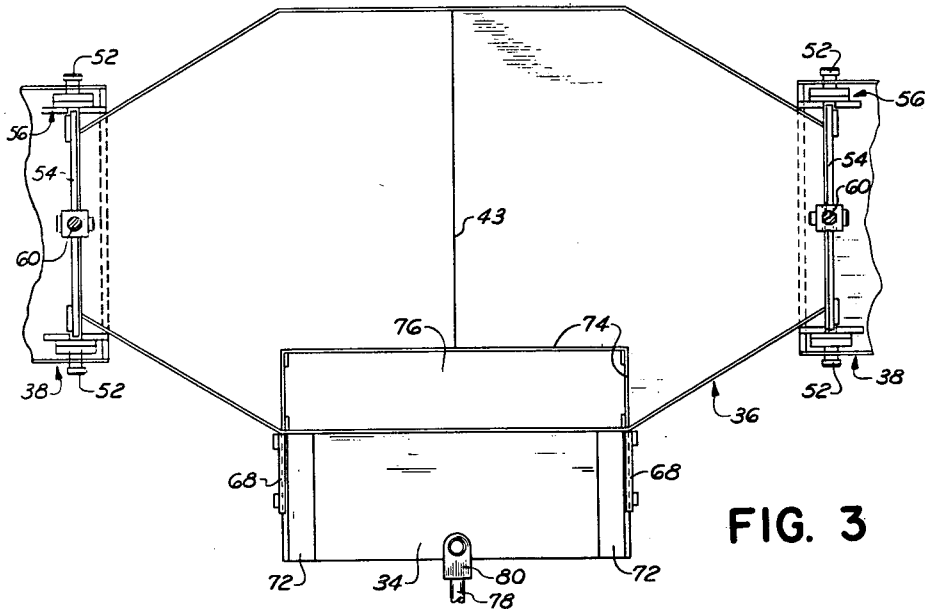
FIG. 3 is a top plan view of the fixed and movable chutes of the apparatus of FIG. 1, fragmentary in nature.
Figure 4:
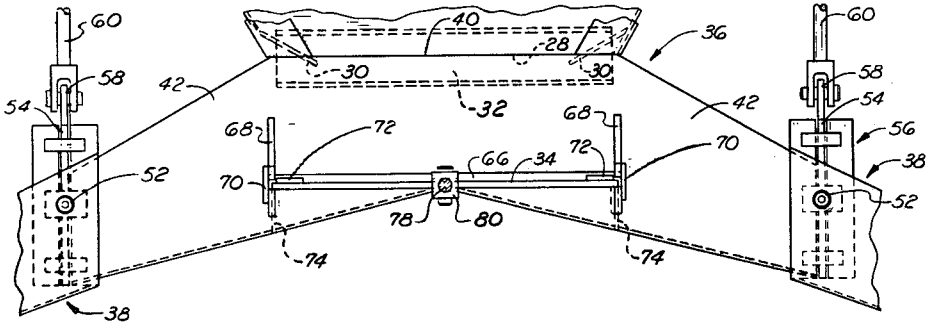
FIG. 4 is a front elevational view of the chutes of FIG. 3.

FIGS. 3, 4, and 5 show a pivot axis 52 for the movable chute means 38. Each movable chute means 38 as best seen in FIG. 4, slightly telescopes over one terminal portion of the fixed chute means 36 and a guillotine-like door 54 is mounted adjacent these interfitting chutes. A frame and guide means is indicated generally at 56 for the guillotine-like doors which are disposed on opposite sides of the ballast spreading apparatus. Each door 54 is provided with a lifting attachment 58 to which a bifurcated end of rod 60 is attached which is actuated by means of a lever 62, FIG. 1, with the aid of a hydraulic cylinder 64.

Figure 7:
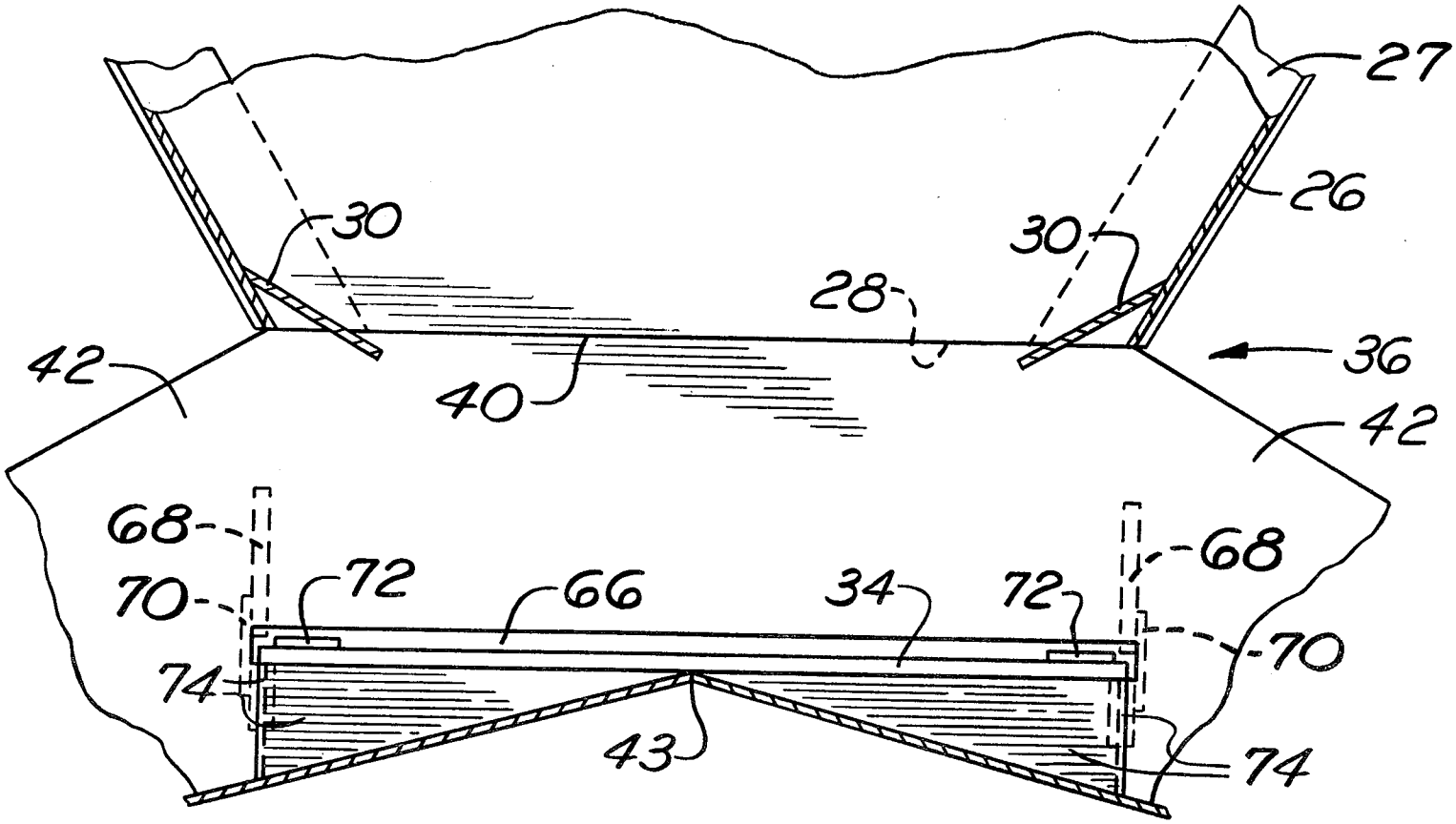
FIG. 7 is a fragmentary elevational view taken in vertical cross section as seen from inside the fixed chute.

Referring now to FIGS. 4, 5 and 7, there is illustrated a slot 66 in an exterior wall of fixed chute means 36 through which door 34 may be reciprocated in a horizontal plane. A pair of center door supports 68 are provided for the centrally located door 34 with a pair of external guide plates 70 being attached to the center door supports. The centrally located door 34 carries internal guide plates 72 to maintain the door 34 in proper sliding position. Vertical walls 74 define a center door box so that when door 34 is open, as is illustrated in FIG. 3, an opening 76 is provided for depositing ballast between the rails. This ballast will not become commingled with ballast in the remainder of the hopper which is dispensed through the fixed chute means 36 laterally into the extension or movable chute means 38. A rod 78 is suitably connected to the center door 34 with the aid of an attachment head 80 and a lever 82 pivotally secured to rear platform 50 as shown in FIG. 1 with power cylinder assist means 84.

Referring again to FIG. 1, ballast is indicated generally at 86 between the cross ties 18 and this ballast has been leveled with the upper surfaces of cross ties 18 with the aid of a resiliently mounted blade means 88. A pair of forwardly mounted suspension rods 92 are attached to the blade means 80 as are a pair of rearwardly disposed suspension rods 92 which are also connected to hydraulic cylinders 94 to provide a resilient mounting. Brackets 96 are also attached to suspension rods 94 to facilitate the lifting and lowering of blade means 88 as required to accommodate any disparity in the elevation of cross ties 18. A hand crank member 100 raises or lowers cable lift means 98.

The ballast spreading means also includes resiliently mounted side blades 102 to which a rod 104 of a hydraulic cylinder 106 is connected. Each side blade 102 has a pair of vertical slide bars 108 received in vertical bushings 110. A horizontal bushing 112 is welded to the frame and receives a horizontal slide bar therein for adjustment for the position of the side blades 102. The horizontal slide bars 114 are welded to the vertical bushings 110 or they could be mounted to a housing fixedly secured to these vertical bushings. Side blades 102 are preferably slightly angled with respect to the railroad rails themselves and are located in a trailing position to clear the heads of cross ties 18 of ballast deposited from hopper 22 through the fixed chute means 36 and movable chute means 38.

Each movable chute means 38 provides a chute enclosed on four sides by means of side walls 116. The movable chute means 38 also includes a vertically downwardly extending extension 118 shown in FIG. 2 having a vertically adjustable terminal portion 120 which is made vertically adjustable by means of slots 122 through which a bolt or other clamping means extends. It is preferred to have the bottom edge portions of the terminal portion 120 contoured to shape the ballast deposited externally of the heads of the cross ties 18. Therefore, the ballast 86 is capable of being shaped by the terminal portion 120 of the movable chute means 36 as is illustrated in FIG. 2 so that it is provided with a desired slope by means of the horizontally extending portion at 124 and the downwardly and outwardly extending portion at 126 of terminal portion 120 whereby the ballast need only be tamped in order to pass final inspection of the railroad grading.

In operation, ballast disposed within the hopper 22 is deposited selectively as desired either centrally of the tracks by opening door 34 to the position shown in FIG. 3 whereby the ballast moves from the hopper toward the open door with the aid of baffle 32 through opening 76 with the door open as shown in FIG. 3.

Simultaneously, or sequentially, ballast may be deposited laterally and exteriorly of the railroad tracks by actuation of one or both of the guillotine-like doors 54 with the aid of one or both of the levers 48 and deposited only where needed and to the extent the ballast is required to provide a proper amount of ballast material at the head of the cross ties with the ballast effectively being throttled through the converging cross sectional area legs 42 of the fixed chute means 36 and then further through the converging cross sectional legs 116 of the extension chutes 38 when in their lowered positions. If one of the chutes is not to be used, the movable chute means 38 is raised with the aid of cable 44 attached to the extension chute under the control of lever 48. The mounting for side blades 102 with slide bars 114 permits lateral outward and inward initial positioning of the side blades.

Because of the ability to dispense only the amount of ballast that is required and because of the shaping of the ballast by the movable chute means, substantial savings are made in both time and hand shoveling requirements. The apparatus may be motor driven or hand propelled as desired.

While a presently preferred embodiment of the invention has been illustrated and described, it will be recognized that the invention may be otherwise variously embodied and practiced within the scope of the claims which follow.

What is claimed is:

1. An apparatus for depositing and spreading ballast between and exteriorly of railroad rails and cross ties which comprises:

a. a frame mounted on wheels with said wheels engageable with said railroad rails, b. hopper means supported by said frame, (1) said hopper means having an open top and an open bottom and being adapted to receive said ballast, (2) said hopper means having laterally extending chute means in fluid communication therewith with said chute means including a fixed chute means with inlet means positioned beneath the open bottom of said hopper means and laterally extending hollow portions extending in opposite directions toward a respective one of said railroad rails and a pair of movable chute means one of which is pivotally secured adjacent the ends of said hollow leg portions, c. first door means located beneath said hopper means to control the deposit of ballast between said rails, (1) said first door means being mounted in a horizontal plane and being extendable through slot means provided in said fixed chute means, d. second door means to control the deposit of ballast exteriorly of said rails, (1) said second door means being mounted for vertical movement within said laterally extending chute means at the juncture between said fixed chute means and said pair of movable chute means, e. first blade means resiliently mounted beneath said frame engageable with ballast deposited between said rails, f. and second blade means resiliently mounted beneath said frame engageable with ballast deposited exteriorly of said rails on the heads of the cross ties.

2. An apparatus for depositing and spreading ballast as defined in claim 1 wherein said fixed chute means and said movable chute means are substantially enclosed on four sides and converge to a smaller cross sectional area in a direction from the center of the tracks outwardly.

3. An apparatus for depositing and spreading ballast as defined in claim 1 including baffle members attached to said hopper means immediately above said fixed chute means.

4. An apparatus for depositing and spreading ballast as defined in claim 1 wherein the lower edge of said movable chute means is shaped to effect a desired contour of said ballast and said movable chute means includes means to adjust the vertical position of the lower edge of said movable chute.

* * * * *